US010596688B2

(12) United States Patent
Bailey et al.

(10) Patent No.: US 10,596,688 B2
(45) Date of Patent: Mar. 24, 2020

(54) NON-METALLIC SPLINE ADAPTER EXTRACTOR

(71) Applicant: SAFRAN ELECTRICAL & POWER, Blagnac (FR)

(72) Inventors: Kirk Bailey, Warren, OH (US); William R. Duncan, Parma, OH (US); Kevin McCrea, Cuyahoga Falls, OH (US)

(73) Assignee: SAFRAN ELECTRICAL & POWER, Blagnac (FR)

( * ) Notice: Subject to any disclaimer, the term of this patent is extended or adjusted under 35 U.S.C. 154(b) by 474 days.

(21) Appl. No.: 15/358,569

(22) Filed: Nov. 22, 2016

(65) Prior Publication Data

US 2017/0144283 A1 May 25, 2017

Related U.S. Application Data

(60) Provisional application No. 62/259,394, filed on Nov. 24, 2015.

(51) Int. Cl.
*B25B 27/06* (2006.01)

(52) U.S. Cl.
CPC ..... *B25B 27/062* (2013.01)

(58) Field of Classification Search
CPC ..... B25B 27/062; Y10T 29/53552; Y10T 29/53557; Y10T 29/5357; Y10T 29/53596; Y10T 29/53657; Y10T 29/53843; Y10T 29/53952; Y10T 29/53991

See application file for complete search history.

(56) References Cited

U.S. PATENT DOCUMENTS 1,107,177 A * 8/1914 Noble ..... F16B 35/005 292/1
1,367,016 A * 2/1921 Campbell ..... B25B 27/062 29/263
1,381,101 A * 6/1921 Albertson ..... B25B 27/06 29/263
2,646,619 A * 7/1953 McCord ..... B25B 27/062 29/263
4,207,664 A * 6/1980 Zoula ..... B25B 27/062 29/264
4,852,235 A * 8/1989 Trease ..... B25B 27/023 29/263

* cited by examiner

*Primary Examiner* — Jason L Vaughan
*Assistant Examiner* — Amanda Kreiling
(74) *Attorney, Agent, or Firm* — Rankin, Hill & Clark LLP

(57) ABSTRACT

An extractor for removing a spline adapter from a housing. The extractor includes a drive rod, and a mandrel that threadingly receives the drive rod. The drive rod is adapted to extend through the mandrel and the spline adapter so as to contact a contact area of the housing to bias the mandrel and the spline adapter in a direction away from the contact area as the drive rod is threaded through the mandrel.

13 Claims, 6 Drawing Sheets

NON-METALLIC SPLINE ADAPTER EXTRACTOR

BACKGROUND

In order to combine rotating components, a variety of methods and devices can be used. For example, an aircraft generator drive shaft interfaces with an aircraft auxiliary driveshaft through a non-metallic spline adapter in a coupling housing. Alternatively, the non-metallic spline adapter can be used in a similar coupling housing for offline testing. This non-metallic spline adapter has an interference fit with the housing. However, once the spline adapter becomes worn, it must be removed and replaced. Traditionally, removal of the spline adapter from the housing results in damage or destruction to the spline adapter. Therefore, any diagnostic evidence regarding the spline adapter cannot be obtained when the spline adapter is removed from the housing.

SUMMARY

In view of the foregoing, an extractor for removing a spline adapter from a housing of a gear drive box includes a drive rod and a mandrel that threadingly receives the drive rod. The drive rod is adapted to extend through the mandrel and the spline adapter so as to contact a contact area of the housing to bias the mandrel and the spine adapter in a direction away from the contact area as the drive rod is threaded through the mandrel.

Additionally, an extractor for removing a spline adapter from a housing can include a drive rod that extends primarily in a longitudinal direction. The drive rod includes exterior threads. The extractor also includes a mandrel that defines a mandrel bore with an inner diameter that engages the exterior threads of the drive rod to threadingly receive the drive rod. The mandrel includes a base portion, a barrel portion, and a head portion. The barrel portion and the head portion cooperate to define a plurality of slots extending in the longitudinal direction so as to permit radial compression of the head portion upon insertion into the spline adapter. The mandrel bore permits passage of the drive rod therethrough for contact with a contact area of the housing that is in registry with the mandrel bore.

An example of a method of removing a spline adaptor from a housing includes providing a drive rod that extends primarily in a longitudinal direction. The drive rod includes a drive end and a driven end. The drive end and the driven end are disposed at opposite ends of the drive rod. The method also includes the step of providing a mandrel with a base portion that defines a base portion outer diameter that is constant and a head portion that defines a head portion outer diameter. The head portion includes an engagement face that faces toward the base portion. A barrel portion of the mandrel is longitudinally disposed between the base portion and the head portion. The barrel portion and the head portion cooperate to define a plurality of slots extending in the longitudinal direction. The method also includes the step of positioning the drive rod so as to be threadingly received only in the base portion of the mandrel to define a retractable condition of the mandrel and also inserting the mandrel into a spline adapter bore of the spline adapter such that the head portion outer diameter decreases as compared to the head portion outer diameter in the retractable condition so as to define a retracted condition. The spline adapter includes an entry port with a leading face and an exit port with a trailing face. The entry port and the exit port are at opposite ends of the spline adapter. The mandrel is inserted through the entry port until the head portion has exited the exit port and the mandrel is able to return to the retractable condition. The method also includes the step of rotating the drive rod in a first direction with respect to the mandrel while the mandrel is received in the spline adapter bore of the spine adapter so that the drive rod is received in the head portion of the mandrel to define a non-retractable condition of the mandrel. The trailing face of the spline adapter faces a contact area of the housing. The drive rod extends through the spline adapter so as to contact the contact area to bias the spline adapter away from the contact area to extract the spline adapter from the housing.

DETAILED DESCRIPTION

An example of an extractor 2 for removing a spline adapter 3 from a housing 4 is shown in FIGS. 1-5. With specific reference to FIG. 1, the spline adapter 3 could be made from a polyamide-imide amorphous polymer, such as TORLON, which is manufactured by Solvay Specialty Polymers. Alternatively, the spline adapter 3 could be made from VESPEL, which is a durable high-performance polyimide-based plastic manufactured by DuPont.

Figure 1:
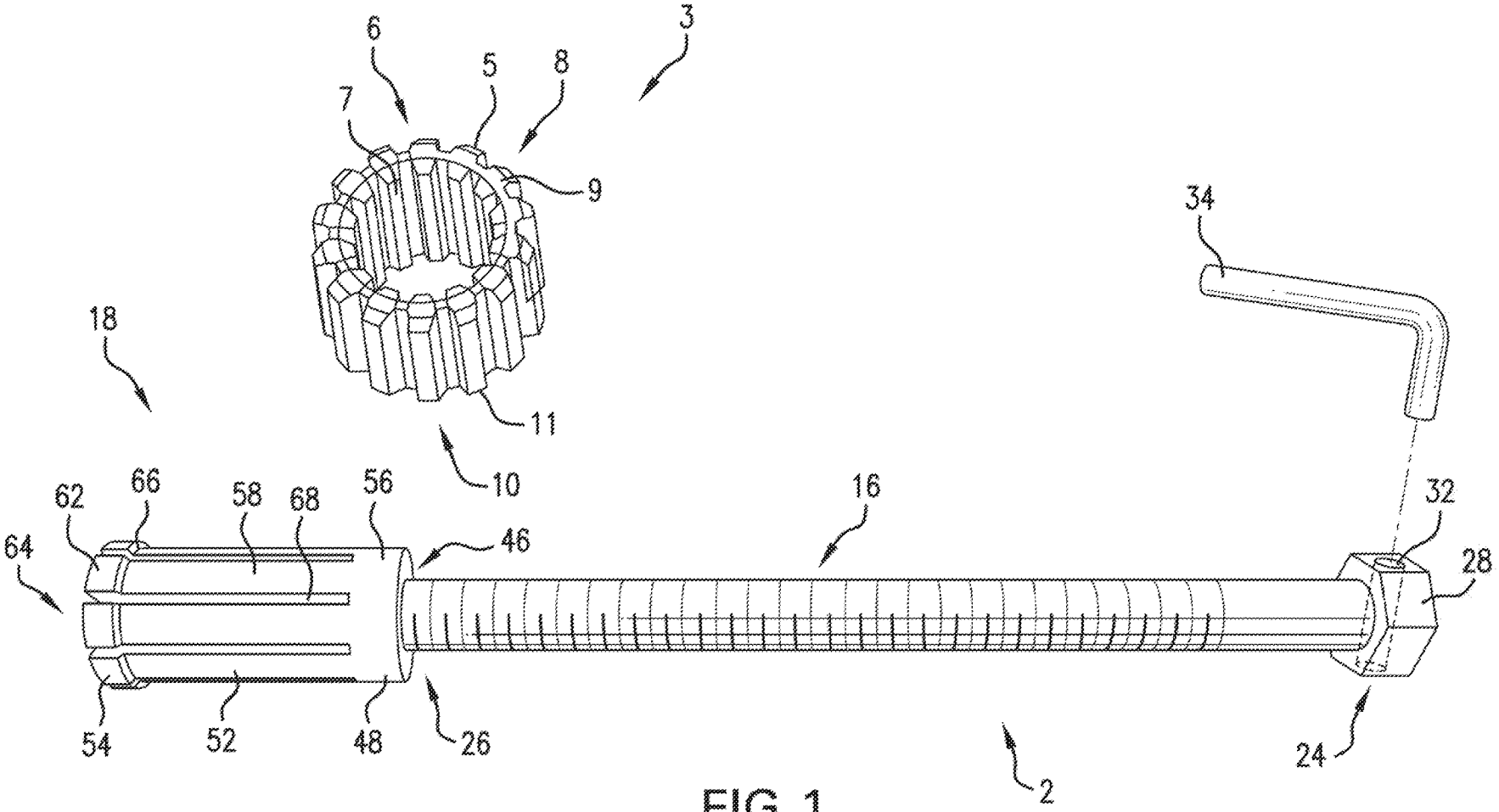
FIG. 1 is a perspective view of an extractor and a spline adapter.

The spline adapter 3 includes a plurality of outer splines 5 that extend in a longitudinal direction of the spline adapter 3. The outer diameter of the spline adapter 3 and the outer splines 5 cooperate for an interference fit with a bore 72 of the housing 4, as will be described in more detail hereinafter. The spline adapter 3 defines a spline adapter bore 6 with a plurality of inner splines 7 that extend in a same direction as the outer splines 5. As shown by FIG. 1, the spline adapter 3 also defines an entry port 8 with a leading face 9 and an exit port 10 with a trailing face 11. For reference, the entry port 8 and the exit port 10 are disposed at opposite longitudinal ends of the spline adapter 3. Further, the entry port 8 and the exit port 10 face away from one another and the leading face 9 and the trailing face 11 also face away from one another and in opposite directions.

In general, the extractor 2 includes a drive rod 16 and a mandrel 18. The drive rod 16 has a generally cylindrical shape and extends primarily in a longitudinal direction. Further, the drive rod 16 includes exterior threads 22 for threaded engagement with the mandrel 18 as will be described hereinafter. The, threads 22 may be any number of threads per inch or pitch without departing from the scope of this disclosure. Further, it will be appreciated that the drive rod 16 could be made from any number of materials, including, for example, carbon steel or toughened stainless tool steel. The portion of the drive rod 16 that includes the threads 22 has a circular cross-sectional shape. Further, the major and minor diameters of the threads 22 each remain generally constant along a longitudinal length of the drive rod 16.

The drive rod 16 includes a drive end 24 and a driven end 26. The drive end 24 and the driven end 26 are disposed at opposite longitudinal ends of the drive rod 16. As will be appreciated, the drive end 24 is the end of the drive rod 16 that a rotational force is applied and the driven end 26 is the end which contacts the housing 4 to remove the spline adapter 3 as will be described in more detail hereinafter.

With continued attention to FIG. 1, the drive end 24 can include a cap 28. As illustrated, the cap 28 has a hexagonal cross-section. This cap 28 allows for engagement with a socket wrench (not shown) and provides for a location for positive engagement of the drive rod 16. It is envisioned that the drive rod 16 could be driven without the use of a socket wrench.

The cap 28 can define a cap bore 32 that can extend entirely through, the cap 28. As shown in the figures, the cap 28 is integral with the drive rod 16. The cap bore 32 extends in a direction that is generally perpendicular to the longitudinal direction of the drive rod 16. The cap bore 32 allows for receipt of a drive handle 34. As illustrated, the drive handle 34 has an L-shape and is circular in cross-section. By inserting the drive handle 34 into the cap bore 32, increased leverage for ease of rotation of the drive rod 16 can be realized. As will be appreciated, the drive handle 34 could be any number of shapes that would increase the arm length for ease of rotation of the drive rod 16. For example, the drive handle 34 could be a straight rod without departing from the scope of the disclosure.

Figure 5:
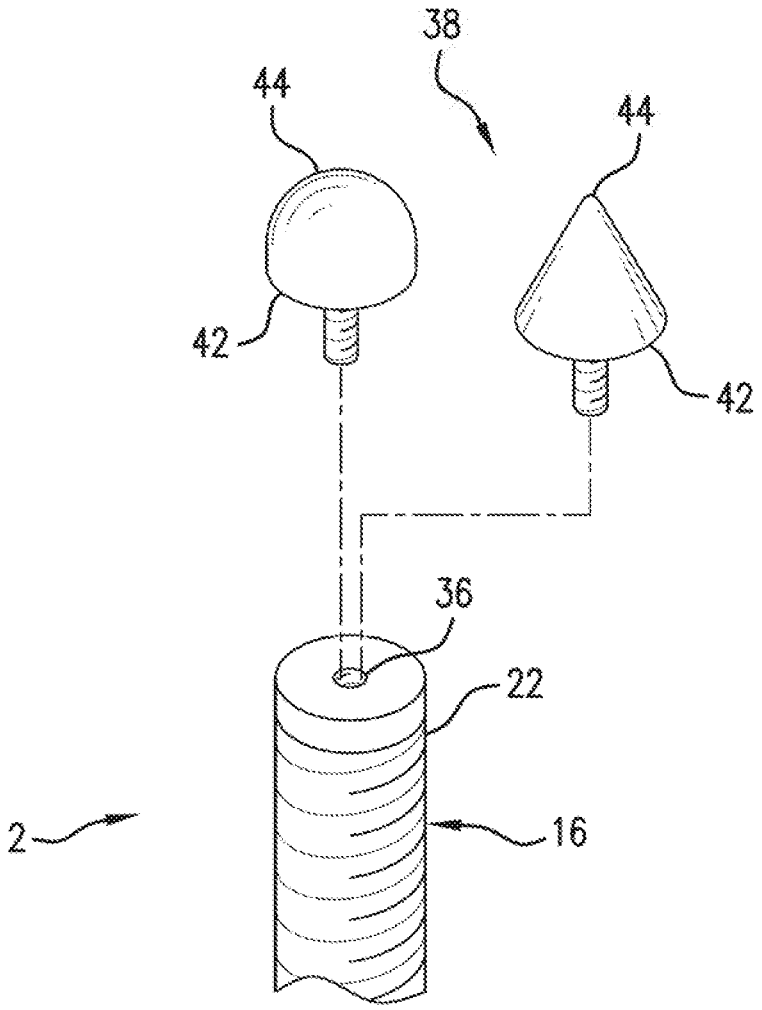
FIG. 5 is a perspective view of the drive rod with a variety of crown elements.
Figure 6:
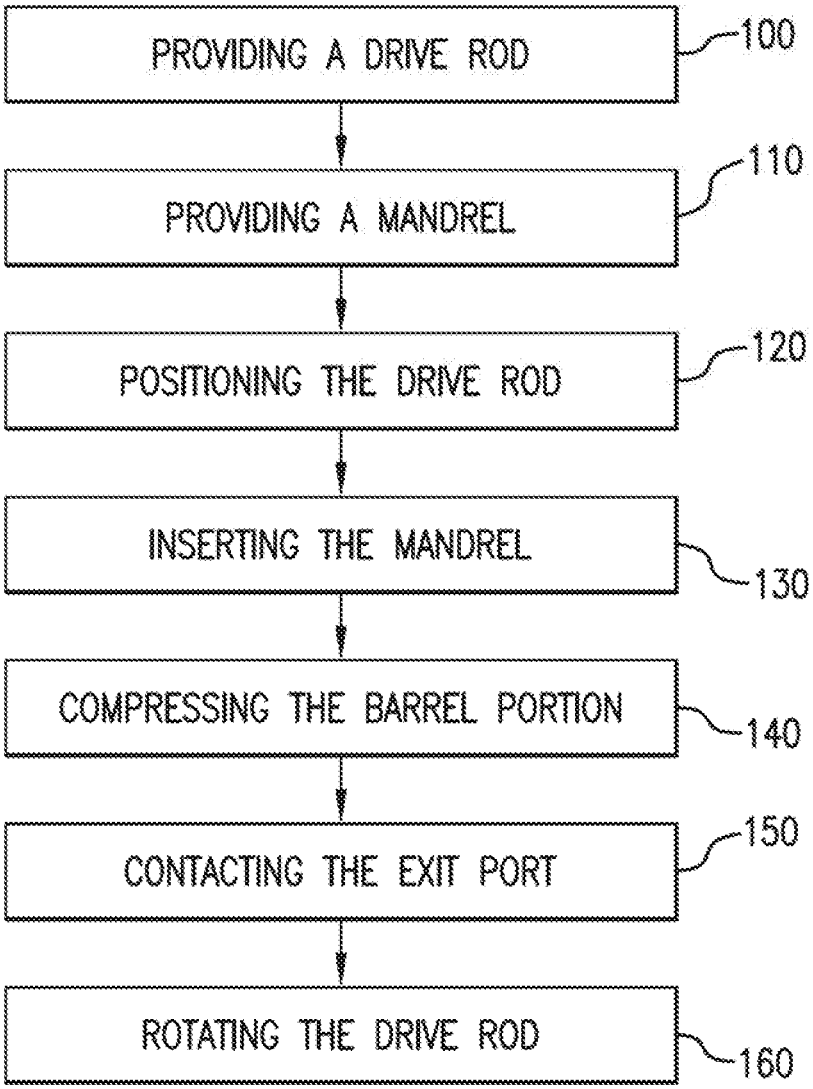
FIG. 6 is a flowchart illustrating a method of removing the spline adapter from the housing.

As shown in FIG. 5, the drive rod 16 can also define a blind bore 36 at the driven end 26 of the drive rod 16. The blind bore 36 includes a thread for engagement with a crown element 38 and is of sufficient depth so as to fully received in a threaded portion of the crown element 38. Thus, the crown element 38 is threadingly engaged to the drive rod 16. As shown, the crown element 38 may be cone shaped or hemisphere shaped.

The crown element 38 includes a threaded rod portion 40 for engagement with the blind bore 36 such that a base 42 of the crown element 38 contacts the drive rod 16 and an apex 44 of the crown element 38 is free. As is considered apparent, the blind bore 36 has a depth that is equal to or greater than the rod portion 40. It will be appreciated that the crown element 38 could be press-fit with the drive rod 16. Thus, the rod portion 40 and the blind bore 36 would not be threaded.

The apex 44 serves to extend an overall length of the drive rod 16. The crown element 38 could be of other shapes without departing from the scope of this disclosure. For example, the apex 44 could be flat. The crown element 38 can be made of the same or similar materials as the drive rod 16. Alternatively, it is also envisioned that the crown element 38 could be made of a non-marring material, such as a type of polymer or of brass.

Figure 2:
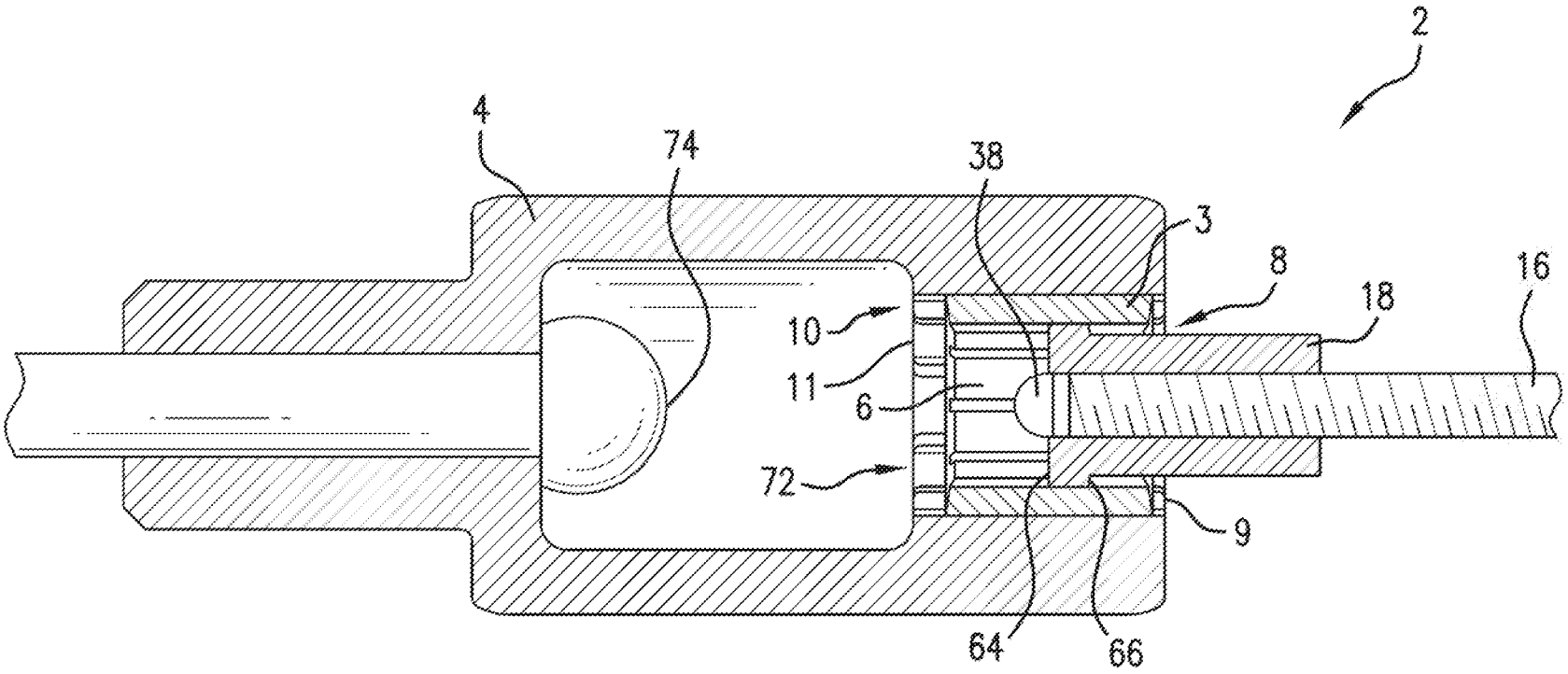
FIG. 2 is a schematic sectional view of the extractor inserted into the housing of a housing that includes the spline adapter.
Figure 3:
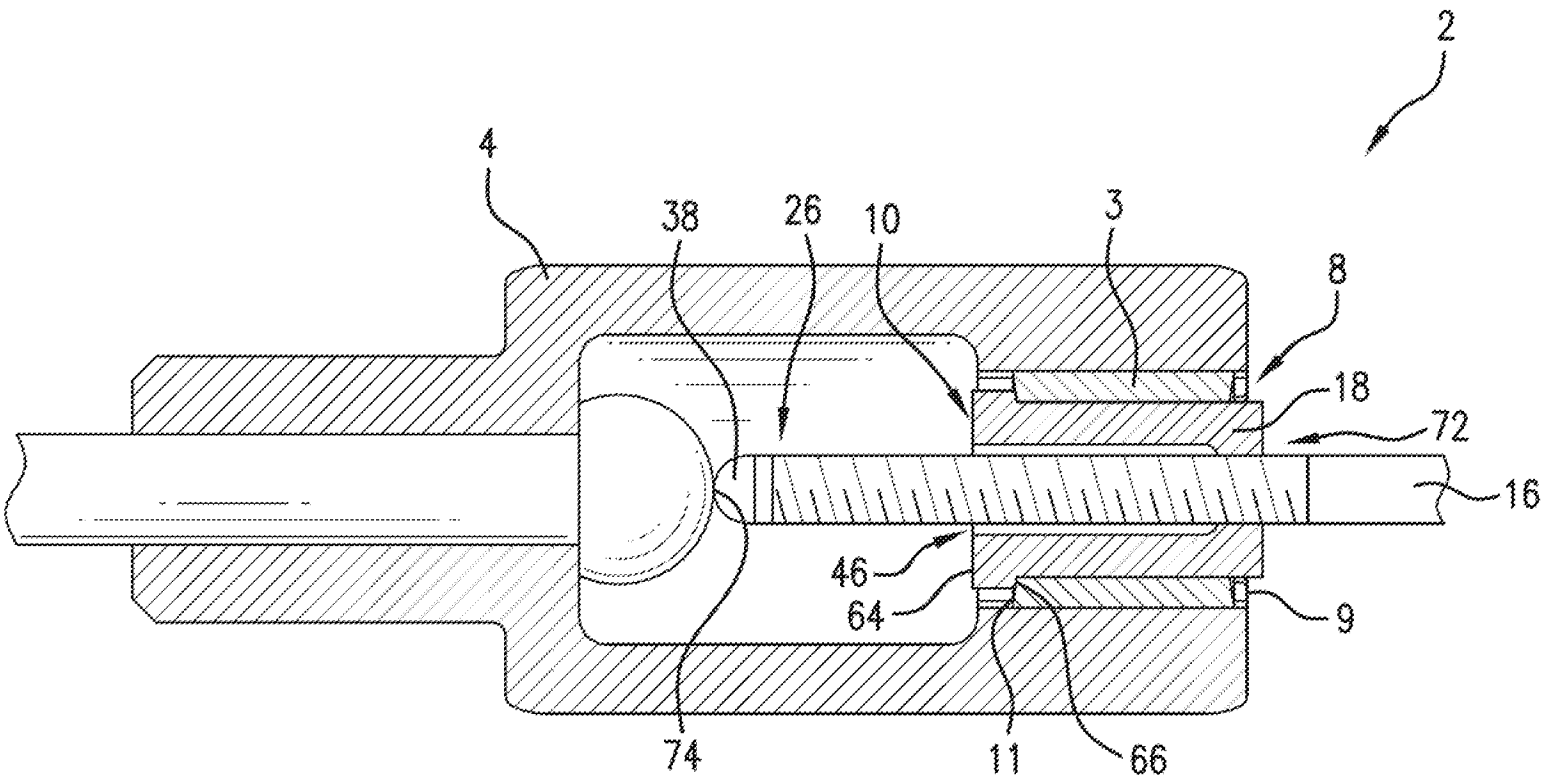
FIG. 3 is a schematic sectional view of the housing in which the drive rod of the extractor has been extended to begin removal of the spline adapter.
Figure 4:
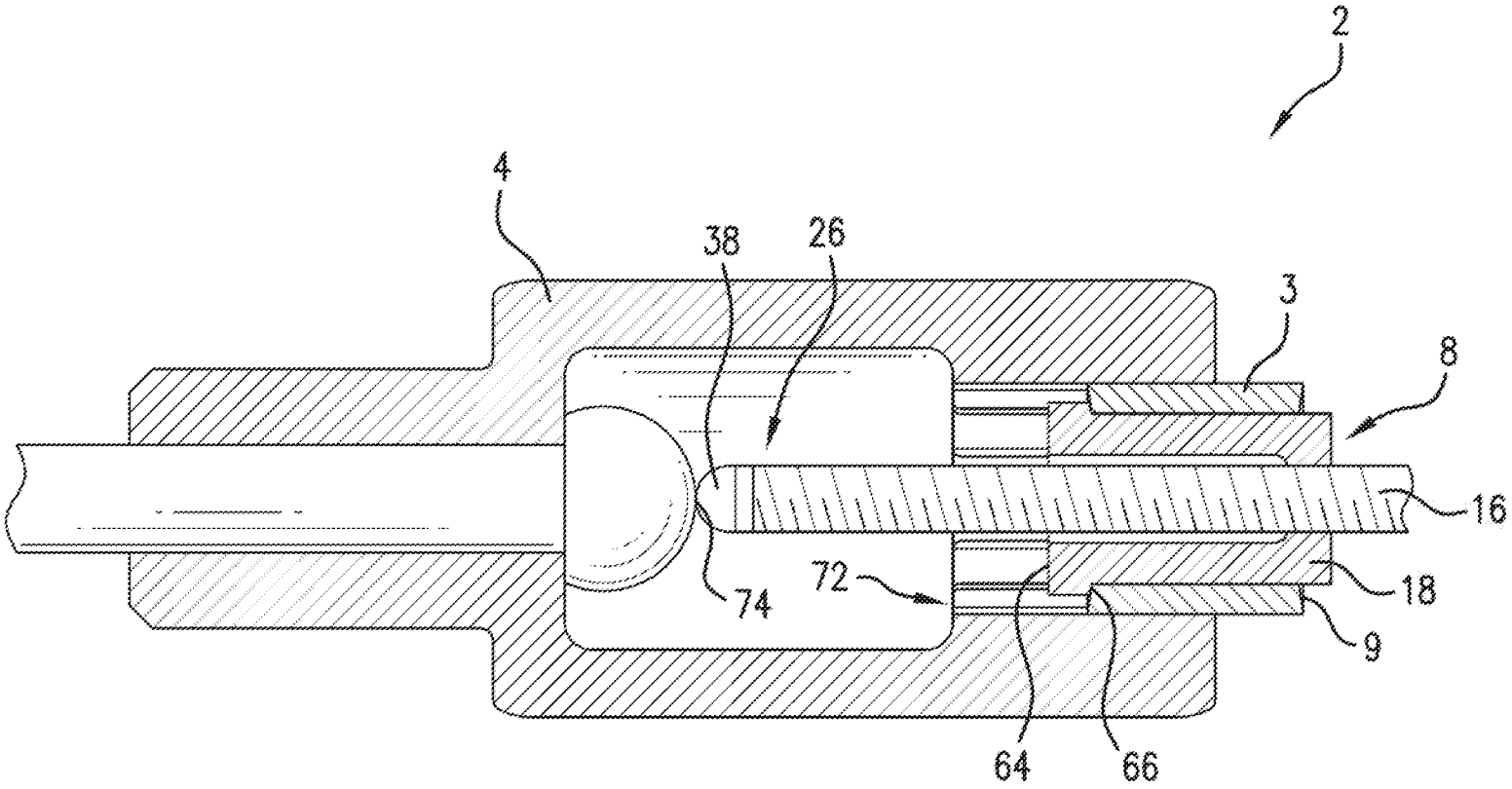
FIG. 4 is a schematic sectional view of the housing in which the spline adapter is further removed from the housing as compared to FIG. 3.

With reference to FIGS. 2-4, the mandrel 18 defines a mandrel bore 46. The mandrel bore 46 has an inner diameter that is sized so as to threadingly receive the drive rod 16. Thus, the threads of the mandrel bore 46 are compatible with the threads 22 of the drive rod 16. Receipt of the drive rod 16 within the mandrel bore 46 prevents collapse of the relevant portion of the mandrel 18. The mandrel 18 is adapted to simultaneously and directly contact the drive rod 16 and the spline adapter 3. Further, the drive rod 16 simultaneously and directly contacts the housing 4 and the mandrel 18. The mandrel 18 can be made of the same or similar materials as the drive rod 16.

The mandrel 18 includes a base portion 48, a barrel portion 52, and a head portion 54. Thus, the base portion 48, the barrel portion 52, and the head portion 54 cooperate to define the mandrel bore 46. Additionally, the base portion 48 defines a base portion outer diameter 56 which is constant. The barrel portion 52 defines a barrel portion outer diameter 58, and the head portion 54 defines a head portion outer diameter 62. The barrel portion 52 is longitudinally disposed between the base portion 48 and the head portion 54.

The base portion outer diameter 56 and the barrel portion outer diameter 58 are less than the spline adapter bore 6 of the spline adapter 3, whereas the head portion outer diameter 62 is usually greater than the spline adapter bore 6 of the spline adapter 3, as will be described in more detail hereinafter.

As shown in the figures, the head portion 54 also includes a feeding face 64 that is curved and an engagement face 66 that is flat. The engagement face 66 faces away from the feeding face 64 and toward the base portion 48 of the mandrel 18. The feeding face 64 faces away from the engagement face 66 and also away from the base portion 48. The curved shape of the feeding face 64 is adapted to contact the spline adapter bore 6 and aids in easing the exertion force necessary for inserting the mandrel 18 into the spline adapter 3. The shape of the engagement face 66 ensures positive engagement with the trailing face 11 of the exit port 10 of the spline adapter 3. In particular, the flat shape of the engagement face 66 allows for full engagement between the mandrel 18 and the spline adapter 3, thereby improving the likelihood that the spline adapter 3 can be removed from the housing 4 without damage. The mandrel bore 46 extends through the feeding face 64 to permit passage of the drive rod 16 therethrough. Further, the engagement face 66 defines a diameter that is greater than an inner diameter of the spline adapter 3.

As also shown in the figures, the barrel portion 52 and the head portion 54 cooperate to define a plurality of slots 68 that extend in the longitudinal direction. These slots 68 allow for radial expansion and contraction of the barrel portion 52 and the head portion 54. The plurality of slots 68 can be equal to eight slots that are radially disposed in an equal angular interval about the mandrel 18.

As shown in FIGS. 2-4, the housing 4 defines a bore 72 and a contact area 74. The bore 72 is circular in shape and is sized so as to receive the spline adapter 3 as an interference fit. As such, removal of the spline adapter 3 from the bore 72 can be difficult. Further, the bore 72 is greater than the bore 6 of the spline adapter 3 and also greater than the head portion outer diameter 62.

As illustrated, the contact area 74 is in registry with the bore 72. The contact area 74 is adapted for contact with the crown element 38 of the drive rod 16 as will be described hereinbelow. As illustrated, the contact area 74 has a hemispherical shape. However, it will be appreciated that the contact area 74 could have other shapes without departing from the scope of this disclosure. Further still, as the contact area 74 is disposed within the housing 4, the arrangement of the extractor 2 is advantageous for extending into the housing bore 72 for contact with the contact area 74 for extracting the spline adapter 3 from the housing 4. Thus, because of the layout of the extractor 2, the crown element 38 can contact the contact area 74 for steady, uniform, and proper alignment during removal of the spline adapter 3 from the housing 4. This is in stark contrast to traditional tools which cannot extend through the spline adapter bore and the housing bore to contact the contact area for biasing purposes.

With reference to FIGS. 2-6, a method of removing the spline adapter 3 from the housing 4 is shown. At Step 100, the drive rod 16 is provided which extends primarily in the longitudinal direction and includes the drive end 24 and the driven end 26. At Step 110, the mandrel 18 with the base portion 48 and the head portion 54 is provided. At Step 120, the drive rod 16 is positioned so as to be threadingly received only in the base portion 48 of the mandrel 18. This defines a retractable condition of the mandrel 18. Stated plainly, the head portion outer diameter 62, and at least a portion of the barrel portion outer diameter 58 is reducible if a radially inward force were to be applied to either the head portion 54 or barrel portion 52 of the mandrel 18.

At Step 130, the mandrel 18 is inserted into the spline adapter bore 6 of the spline adapter 3. This results in the head portion outer diameter 62 decreasing as compared to the head portion outer diameter 62 in the retractable condition so as to define a retracted condition. This radial compression of the head portion outer diameter 62 causes at least a portion of the barrel portion 52 to reduce in size. Notably, the longitudinal portions separated by the slots 68 pivot radially inward at the joint created by the junction of the base portion 48 and the barrel portion 52. Plainly stated, the barrel portion 52 and the head portion 54 are radially pivoted inward when the mandrel 18 is inserted into the spline adapter bore 6 of the spline adapter 3.

At Step 150, the mandrel 18 is inserted through the entry port 82 until the head portion 54 exits the exit port 10, the mandrel 18 is able to return to the retractable condition (i.e., the head portion outer diameter 62 is no longer compressed), and the engagement face 66 contacts the trailing face 11 of the exit port 10 of the spline adapter 3.

At Step 160, the drive rod 16 is rotated in a first direction with respect to the mandrel 18 while the mandrel 18 is received in the spline adapter bore 6 of the spline adapter 3 so that the drive rod 16 is received in the head portion 54 of the mandrel 18 to define a non-retractable condition of the mandrel 18. Thus, the trailing face 11 of the spline adapter 3 faces the contact area 74 of the housing 4. Due to the threaded engagement between the drive rod 16 and the mandrel 18, rotation of the drive rod 16 in the first direction results in a distance between the crown element 38 and the mandrel 18 increasing and a distance between the cap 28 and the mandrel 18 decreasing. Thus, the drive rod 16 is rotated with respect to the mandrel 18 until a distance between the head portion 54 and the driven end 26 is greater than a longitudinal length of the spine adapter 3. Further, rotating the drive rod 16 with respect to the mandrel 18 while the trailing face 11 of the exit port 10 remains in contact with the engagement face 66 of the head portion 54 of the mandrel 18, results in displacement of the spline adapter 3 from the housing 4.

The drive rod 16 extends through the mandrel 18 and the spline adapter 3 so as to contact the contact area 74 to bias the spline adapter 3 away from the contact area 74 to extract the spline adapter 3 from the housing 4. This is due to the fact that the contact area 74 is fixed in the longitudinal direction and in registry with the spindle adapter bore 6.

By extending through the mandrel 18 and the spline adapter 3 that is within the housing bore 72, the drive rod 16, the mandrel 18, the spline adapter 3, the housing bore 72 remain in coaxial alignment during removal of the spline adapter 3 from the housing bore 72. This results in a removal of the spline adapter 3 without damage to the spline adapter 3. Thus, forensic/failure analysis can be conducted on the spline adapter 3 without concern of whether any damage to the spline adapter 3 occurred during removal from the housing bore 72.

For reference, when the mandrel 18 is in the non-retractable condition, the outer diameter of the head portion 54 of the mandrel 18 is greater than a diameter of the exit port 10 of the spline adapter 3 and less than a diameter of the housing bore 72 of the housing 4 so as to permit removal of the mandrel 18 and the spine adapter 3 from the housing 4.

Once the extractor 2 has removed the spline adapter 3 from the housing 4, the drive rod 16 is rotated in a second direction (opposite the first direction) with respect to the mandrel 18 until the drive rod 16 is received solely in the base portion 48 of the mandrel 18 so as to return the mandrel 18 to the retractable condition. Then, the head portion 54 and at least a portion of the barrel portion 48 can be radially compressed to remove the mandrel 18 from the spline adapter 3. It will be appreciated that rotation of the drive rod 16 in the second direction can occur when a portion of the extractor 2 is still within the housing 2 or when the extractor 2 is completely removed from the housing 4.

For reference, the spline adapter 3 could be easily damaged during removal from the housing 4 if proper methods and tools (i.e., extractor 2) were not utilized. If the spline adapter 3 was merely being replaced, damage to the spline adapter 3 created during removal from the housing 4 would not be an issue. However, for diagnostic purposes, this damage during removal is unacceptable. By utilizing the above method and extractor 2, a uniform force is applied to the spline adapter 3. This results in improved performance for removing the spline adapter 3 from the housing 4, as compared to various other tools and methods which use and rely on an impulse type of force application to the spline adapter 3 and/or the housing 4.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An extractor for removing a spline adapter from a housing, the extractor comprising:

a crown element configured for contact with the housing;

a drive rod that extends primarily in a longitudinal direction so as to define a drive rod length, wherein the drive rod defines a blind bore that threadingly receives the crown element; and a mandrel that defines a mandrel length that extends from a fixed diameter base portion to an adjustable diameter head portion so as to be less than the drive rod length, wherein the mandrel threadingly receives the drive rod and defines a plurality of slots extending in the longitudinal direction so as to permit radial compression of the head portion, wherein the drive rod is adapted to extend through the mandrel and the spline adapter such that the crown element contacts a contact area of the housing to bias the mandrel and the spline adapter in a direction away from the contact area as the drive rod is threaded through the mandrel.

2. The extractor of claim 1, wherein the base portion defines a base portion outer diameter, a barrel portion defines a barrel portion outer diameter, and the head portion defines a head portion outer diameter.

3. The extractor of claim 2, wherein the barrel portion is longitudinally disposed between the base portion and the head portion.

4. The extractor of claim 2, the base portion, the barrel portion and the head portion cooperating to define a mandrel bore extending therethrough that threadingly engages the drive rod.

5. The extractor of claim 4, the head portion including a feeding face that is curved and an engagement face that is flat, the engagement face facing away from the feeding face and, toward the base portion of the mandrel, wherein the mandrel bore extends through the feeding face to permit passage of the drive rod.

6. The extractor of claim 5, wherein when the drive rod is received in the head portion, the engagement face defines a diameter that is greater than an inner diameter of the spline adapter.

7. An extractor for removing a spline adapter from a housing, the extractor comprising:

a crown element configured for contact with the housing;

a drive rod that extends primarily in a longitudinal direction so as to define a drive rod length, the drive rod including exterior threads, wherein the drive rod defines a blind bore that threadingly receives the crown element; and a mandrel that defines a mandrel bore with an inner diameter that engages the exterior threads of the drive rod to threadingly receive the drive rod, wherein the mandrel defines a mandrel length that extends from a fixed diameter base portion to an adjustable diameter head portion so as to be less than the drive rod length, the mandrel including a barrel portion that cooperates with the head portion to define a plurality of slots extending in the longitudinal direction so as to permit radial compression of the head portion upon insertion into the spline adapter, wherein the mandrel bore permits passage of the drive rod therethrough such that the crown element contacts a contact area of the housing that is in registry with the mandrel bore.

8. The extractor of claim 7, wherein the base portion defines a base portion outer diameter that is constant independent of position of the drive rod.

9. The extractor of claim 7, wherein the drive rod includes a drive end with a cap with a hexagonal cross-section and a driven end that is free, wherein the cap is configured for engagement with a socket wrench and defines a cap bore that extends in a direction generally perpendicular to the longitudinal direction for receipt of a drive handle, and wherein the drive rod includes external threads that extend from the driven end toward the drive end.

10. The extractor of claim 9, wherein the crown element is cone-shaped and is disposed such that a base of the crown element contacts the drive rod and an apex of the crown element is free.

11. The extractor of claim 7, wherein the plurality of slots is equal to eight slots that are radially disposed in an equal angular interval about the mandrel.

12. The extractor of claim 7, wherein the head portion includes a feeding face that is curved and an engagement face that is flat, the engagement face facing away from the feeding face and toward the base portion of the mandrel, and wherein the mandrel bore extends through the feeding face to permit passage of the drive rod therethrough.

13. The extractor of claim 7, wherein the drive rod is adapted to directly contact the housing and the mandrel, and wherein the mandrel is adapted to directly contact the drive rod and the spline adapter.

* * * * *